United States Patent [19]

Fitzner

[11] 4,015,564

[45] Apr. 5, 1977

[54] IGNITION SYSTEM FOR INTERNAL-COMBUSTION ENGINES HAVING TIMING STABILIZING MEANS

[75] Inventor: Arthur O. Fitzner, Fond du Lac, Wis.

[73] Assignee: Brunswick Corporation, Skokie, Ill.

[22] Filed: Aug. 14, 1974

[21] Appl. No.: 497,319

[52] U.S. Cl. ..... 123/117 R; 123/148 CC

[51] Int. Cl.[2] ..... F02P 5/04

[58] Field of Search .... 123/148 E, 148 MC, 117 R; 315/209 R

[56] References Cited

UNITED STATES PATENTS

| | | | |
|---|---|---|---|
| 3,518,485 | 6/1970 | Leathem | 315/209 R |
| 3,573,545 | 4/1971 | Warner | 123/117 R |
| 3,715,650 | 2/1973 | Draxler | 123/148 MC |
| 3,741,185 | 6/1973 | Swift et al. | 123/148 MC |
| 3,783,850 | 1/1974 | Habert | 123/148 E |
| 3,805,759 | 4/1974 | Fitzner | 123/117 R |
| 3,874,349 | 4/1975 | Fitzner | 123/148 E |

*Primary Examiner*—Charles J. Myhre
*Assistant Examiner*—Paul Devinsky
*Attorney, Agent, or Firm*—Andrus, Sceales, Starke & Sawall

[57] ABSTRACT

Ignition in a six-cylinder internal combustion engine is supplied by a pair of similar alternator-driven, alternate-firing, capacitor discharge ignition systems, each discharged to the several spar k plugs of its own three cylinders by individual controlled rectifiers. A common trigger pulse generator is magnetically coupled to the engine flywheel and includes three individual trigger coils for generating properly referenced and angularly spaced pulses, each coil producing alternating positive and negative polarity pulses. A steering diode network connects one end of each triggering coil to a related controlled rectifier for an associated spark plug in one cylinder group and the opposite end of each coil to the controlled rectifier for a spark plug in the second cylinder group. Each ignition system includes a bias capacitor connected in series with the output of the three triggering coils to maintain an essentially constant ignition angle relative to trigger coil position over a wide range of engine speeds, and to establish back bias on each controlled rectifier gate-to-cathode junction during the intervals between trigger pulses. A pair of series connected resistors is connected in parallel with the bias capacitor with the center node supplying only a portion of the bias capacitor voltage to the gate to cathode junction of the related controlled rectifier in the absence of the triggering pulse. For a three cylinder engine a single one of the ignition systems is employed, and uses a wye-connection of the trigger coils in the trigger generator, the neutral wire being brought out and connected to the bias capacitor.

24 Claims, 4 Drawing Figures

IGNITION SYSTEM FOR INTERNAL-COMBUSTION ENGINES HAVING TIMING STABILIZING MEANS

BACKGROUND OF THE INVENTION

This invention relates to a triggered ignition system and particularly to a system employing switching means for selectively supplying energy to the several ignition means with respect to a selected desired firing point.

Electronic ignition systems have recently been developed to provide improved ignition in internal combustion engines and the like. A highly satisfactory electronic system employs a capacitor which is charged to a relatively high voltage and then rapidly discharged thru a step-up ignition transformer to provide the firing energy to a selected spark plug. Such capacitor discharge ignition systems may employ a battery power supply in combination with a dc to dc converter for charging of the capacitor to the firing level or alternatively may employ an alternator coupled to and driven by the engine to produce an alternating output which is rectified and applied to charge the capacitor.

Capacitor discharge ignition systems and the like have also been developed with individual outputs for the several cylinders in order to eliminate the requirement for distributors and the like. Further, such systems may be advantageously constructed with special trigger signal generating circuits to eliminate the necessity for breaker points.

A very satisfactory capacitor discharge ignition system is shown in applicant's recently issued U.S. Pat. No. 3,805,759 entitled IGNITION SYSTEM WITH ADVANCE STABILIZING MEANS. As more fully disclosed in such application particularly as applied to an outboard motor or the like, an alternator is coupled to the flywheel of an internal combustion engine and connected via a rectifier circuit to charge a main firing capacitor. A separate signal generator is also coupled to the flywheel and establishes properly timed individual triggering signals. The output of the main firing capacitor is connected to a discharge network including a controlled rectifier, the gate of which is connected to the output of an appropriate trigger circuit to provide for the discharge of the capacitor for firing of the appropriate spark plug of the engine. A bias network is incorporated into the trigger circuit to prevent uncontrolled or erratic advanced firing which can result in a condition of engine speed instability and possible engine damage.

As described in U.S. Pat. No. 3,805,759 in connection with a two-cylinder outboard motor, the bias network creates a variable threshold voltage approximately matched to the variable trigger signal strength. Thus, at low speeds when the trigger signal is low, a low bias signal is introduced and, consequently, has little or no effect on the ignition timing. As the rotational engine speed increases which generates an increasingly strong trigger signal, the self-generating bias circuit introduces a corresponding larger opposing bias which must be overcome by the trigger signal. Applicant has found that the opposing bias network effectively neutralizes any change in the ignition angle with engine speed such as heretofore encountered. Further, with the bias network there is essentially no sudden large change of the ignition angle with a change in the angular position of the spark advance mechanism or with increasing engine speed; at most the change may be made to appear only as a relatively insignificant one-half degree jump in a practical outboard motor in the speed range of from 4,000 to 6,000 revolutions per minute. As a result, a desirable and consistent correlation between the ignition angle and the angular setting of the spark advance mechanism is established and is maintained stable for all speeds.

Such a self-generating bias network includes a parallel capacitor and resistor connected in series with the output of the trigger pulse generator and the triggering circuit means.

A multiple cylinder internal combustion engine ignition system employing a plurality of similar cascaded trigger and firing circuits for the several cylinders is also shown in applicant's co-pending application entitled "IGNITION SYSTEM FOR MULTIPLE CYLINDER INTERNAL COMBUSTION ENGINES HAVING AUTOMATIC SPARK ADVANCE", filed on May 10, 1973 with Ser. No. 359,137 now U.S. Pat. No. 387439. Diode and switching means connect the opposite polarity triggering pulses to the different firing circuits for a related pair of spark plugs to provide for an automatic spark advance at a selected speed.

A rotating magnet generator similar to that shown in U.S. Pat. No. 3,715,650 issued to James R. Draxler for a "PULSE GENERATOR FOR IGNITION SYSTEMS", is employed to generate relatively positive and negative pulse signals at oppositely located magnetic discontinuities. With any given single coil, it is merely necessary to rearrange the magnets to locate the discontinuities at appropriate points, to automatically generate a retarded of first polarity triggering pulse for a first spark plug in a first cylinder, and an advanced or second polarity triggering pulse for a second spark plug in a second cylinder, which pulses are conducted into the circuit by suitable switching and steering means connected to the opposite ends of each trigger coil or winding in accordance with the teaching of the above referenced application Ser. No. 359,137.

A self-biasing network is employed therein not only to stabilize the triggering but also to define a tachometer type signal directly related to the operating speed of the engine. The tachometer signal is applied to an electronic switching circuit to activate the second polarity signal circuitry to establish the automatic ignition angle advance.

Applicant has found that, although the biasing system of U.S. Pat. No. 3,805,759 provides highly significant improved results, and has further proved its usefulness by providing a tachometer type signal to initiate an automatic spark advance in the referenced co-pending application, the voltage which was developed across the bias capacitor was severely limited by the gate-to-cathode reverse voltage limitation of most controlled rectifier devices.

Thus, when the trigger generator is contructed to supply adequate trigger signals to assure easy engine starting at the low cranking speeds, the result is a relatively high peak extrapolated trigger voltage, generally in the order of 100 volts, at the maximum engine speeds. Extrapolatin is necessary to reveal the true nature of the high speed trigger signal inasmuch as a heavy added resistive load is applied to the trigger generator whenever the trigger signal exceeds the triggering threshold, which greatly reduces the observed peak voltage and naturally distorts the inherent trigger signal waveshape. The extrapolated high speed trigger signal can be readily observed by mechanically rotating the engine flywheel with the heavy added resistive load disconnected.

Applicant has found that the steepest portion of the leading edge of this extrapolated trigger pulse lies between one-third and two-thirds of the full peak extrapolated voltage. Triggering in the steepest portion of the leading edge of the extrapolated trigger pulses has been determined to provide the most precise ignition timing and the most precise spark angle relationships between cylinders. However, the back-bias stabilizing voltage must then be of the order of at least 35 volts.

Unfortunately, the reverse voltage blocking characteristic of the typical gate-to-cathode junction of a controlled rectifier is of a relatively low voltage level, generally of the order of 12 to 15 volts. Consequently, during the period of time that the triggering voltage is at or near zero, the gate-to-cathode junction of the controlled rectifier is subjected to the full voltage of the bias capacitor. Whenever the voltage of the bias capacitor tends to rise above the 12 to 15 volt range, the junction will conduct and permit a reverse current tending to drain the charge from the bias capacitor with a corresponding reduction in the back bias stabilizing voltage.

SUMMARY OF THE INVENTION

The present invention is particularly directed to triggering circuit networks employing a self-biasing network to maintain a substantially constant ignition angle in the presence of variations in engine speed, supplying triggering signals to a triggered switch means having an input gate means of a limited reverse voltage blocking capability. Generally, in accordance with the present invention, the biasing network includes a capacitive bias voltage means connected in series circuit with the triggering signal source means of the triggered switch means which is connected to control the discharge of an ignition capacitor unit. A voltage dividing means is connected across the capacitive bias voltage means with an intermediate voltage tap connected to the triggered switch means to limit the voltage of the capacitive bias means applied across the input of the triggered switch means during the turn-off period, thereby significantly limiting the applied reverse voltage to a low level which is readily blocked by the gate of the switch means, while simultaneously permitting generation and utilization of optimum trigger and bias voltages at significantly higher levels.

In a practical and novel circuit, the bias capacitor is connected to the ground or cathode side of the gate to cathode junction of a controlled rectifier. The gate is connected to a triggering signal source in series with a suitable gate resistor and diode network to provide proper transfer of a pulse signal to the gate. A pair of voltage dividing resistors are connected directly in parallel with the bias capacitor and have a common junction or node which is connected to the gate and particularly to the input side of the gate resistor. The voltage dividing resistors are selected to divide the voltage of the bias capacitor at given operating speeds, particularly wide open throttle speed, to thereby reduce the reverse voltage applied across the gate to cathode junction of the controlled rectifier to the order of 10 to 12 volts. The gate to cathode junction can readily block such reverse voltage magnitude and will, therefore, prevent draining of current out of the capacitor and maintain the desired charge on the capacitor With the present invention, applicant has found that the system may be conveniently designed with a peak extrapolated or inherent triggering voltage of 135 volts and the biasing voltage approximately of the order of one-third of 135 volts, namely 45 volts, with the reverse voltage applied across the gate-to-cathode junction dropped to the order of 10 to 12 volts. The system maintains the triggering level at about the one-third peak voltage level and thus in the relatively steep portion of the extrapolated triggering voltage pulse.

In a practical construction for a six-cylinder engine or the like, a pair of basic units each constructed for a three-cyliner engine may be combined with a three winding trigger generator connected to provide alternate triggering of the two basic units. Each basic unit would in practice provide ignition to one group of three cylinders at 120° relation to one another, with the firings of the two basic units interleaved at a 60° relationship to one another.

BRIEF DESCRIPTION OF THE DRAWINGS

The drawings furnished herewith illustrate a preferred construction of the present invention in which the above advantages and features are clearly disclosed as well as others which will be readily understood from the description of the illustrated embodiments.

In the drawings.

DESCRIPTION OF THE ILLUSTRATED EMBODIMENT

Figure 1:
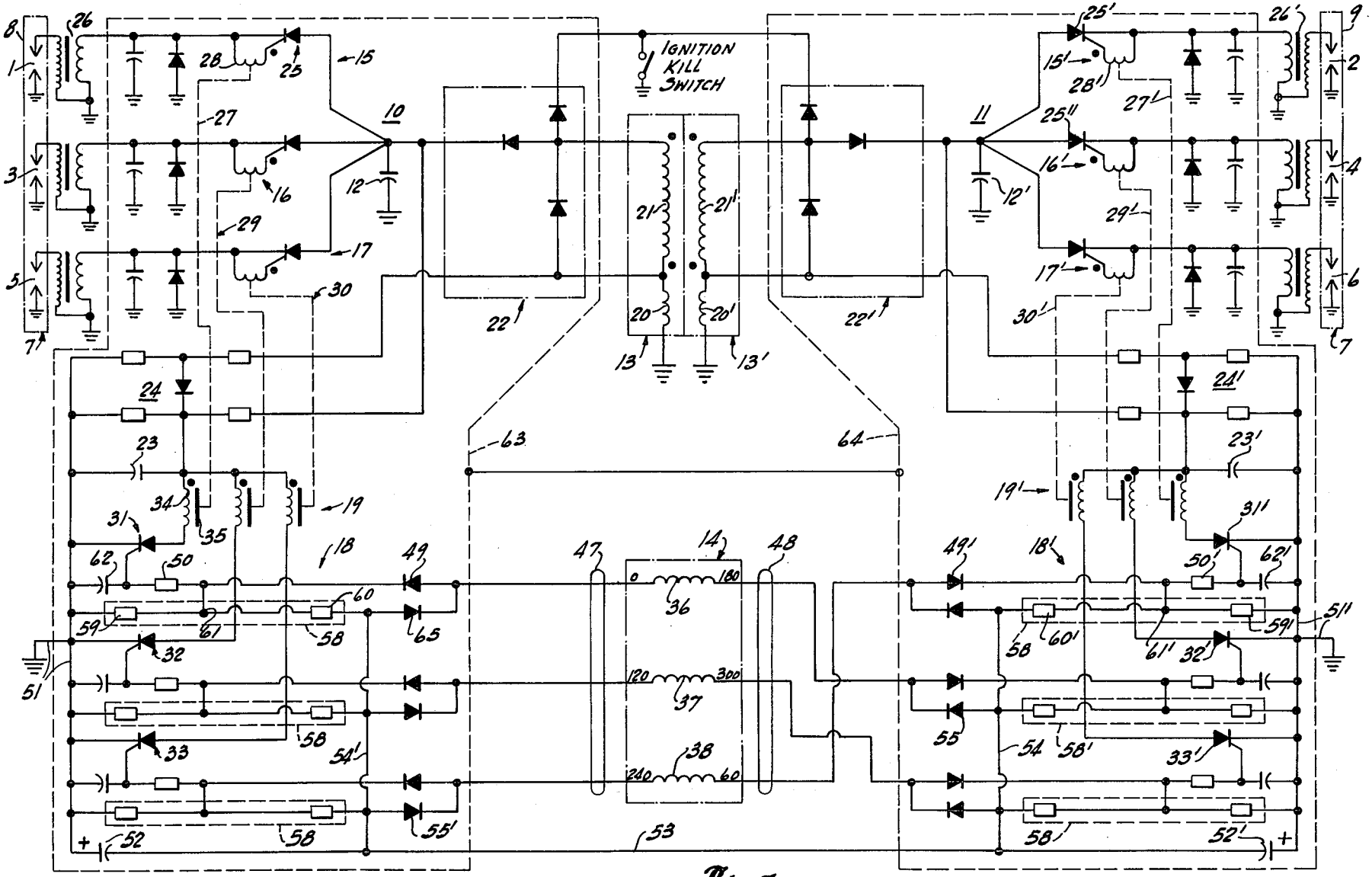
FIG. 1 is a schematic illustration of a capacitor discharge ignition system for a six-cylinder engine employing triggering circuitry constructed in accordance with the present invention.
Figure 2:
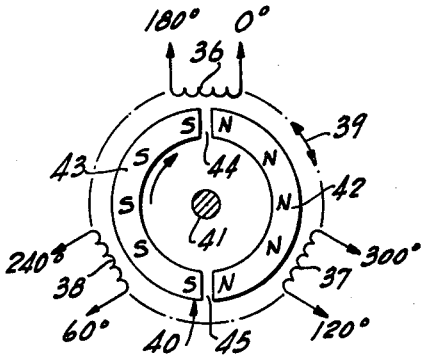
FIG. 2 is a simplified diagrammatic illustration of the triggering generator constructed to operate the ignition system shown in FIG. 1, the magnetic relationships and mechanical structure being more fully described in U.S. Pat. No. 3,715,650 referenced herein.

Referring to the drawings and particularly to FIGS. 1 and 2, a six-cylinder engine includes six individual spark plugs 1, 2, 3, 4, 5 and 6 for firing of the individual cylinders as diagrammatically illustrated at 7. The spark plugs 1–6 are grouped into a first group 8 and a second group 9 with the successive firings alternating between groups. Thus, in the illustrated embodiment, the spark plugs are numbered in accordance with the firing order. Each one of the two spark plugs groups 8 and 9 is shown connected via appropriate ignition transformer groups to a similar capacitor discharge ignition units 10 and 11. Thus, the circuit of group 8 will be described with the corresponding elements of the circuit for group 9 identified by corresponding primed numbers. A first common capacitor 12 is charged to provide energy to the several spark plugs 1, 3 and 5 of the first group 8 in proper time spaced relationship so as to achieve the correct angular relationship to the rotating crankshaft of engine 7. The capacitor 12 is charged from an alternator portion 13 coupled to and driven by the engine. The discharge of the capacitor 12 is controlled by a trigger generator 14 which is common to the circuit of both groups 8 and 9. The output of generator 14 b selectively directed to actuate individual discharge circuits 15, 16 and 17 through diode steering and electronic switching circuits 18 and through cascaded coupling circuit 19 to provide for proper time spaced firing of plugs 1, 3 and 5 for operation of the engine. Alternator portion 13, discharging circuits 15–17 and coupling circuit 19 are essentially as shown in applicant's previously identified co-pending application and are only briefly described herein.

The alternator portion 13 is preferably and dual winding power source having a high speed winding 20 and a low speed winding 21 connected by a diode network 22 for desired high and low speed charging of capacitor 12. A triggering circuit capacitor 23 which controls the discharge of capacitor 12 to the related spark plugs 1, 3 or 5 is also charged from the alternator 13 through a diode-resistance network 24. When the ignition kill switch is closed, diode network 22 diverts the positive voltage output of alternator windings 20 and 21 to ground, thus killing the entire ignition system.

The several discharge circuits 15, 16 and 17 are similarly constructed. The discharge circuit 15 includes an electronic discharge switch 25 shown as a controlled rectifier connecting the positive side of the capacitor 12 to the primary of a related ignition transformer 26, the secondary of which is connected across the related spark plug 1. With capacitor 12 charged, the firing of controlled rectifier 25 results in the capacitor 12 being rapidly discharged through the ignition transformer 26 to fire the related spark plug 1.

The controlled rectifier 25 is controlled in proper timed relation by the output of the trigger signal generator 14 and in particular is connected thereto in the illustrated embodiment of the invention through the cascaded trigger circuit 19 including a coupling transformer 27 having a secondary winding 28 connected across the gate-to-cathode junction of the controlled rectifier 25.

The circuits 16 and 17 are similarly controlled by individual coupling transformers 29 and 30 of circuit 19.

The cascaded circuit 19, as shown in applicant's copending application, includes the common capacitor 23 forming a common power source for selective discharge through the respective transformers 27, 29 and 30.

The capacitor 23 is discharged through the respective transformers 27, 29 and 30 for firing of the firing circuits 15, 16 and 17 to spark plugs 1, 3 and 5 by selective triggering of associated controlled rectifiers 31, 32 and 33, respectively, of circuit 18. The circuit for the spark plug group 9 is similarly constructed with an alternator portion 13′ connected to charge capacitor 12′ which is discharged through individual circuits 15′, 16′ and 17′ to spark plugs 2, 4 and 6; employing controlled rectifiers 31′, 32′ and 33′ connected to circuit 18′ plus cascaded coupling circuit 19′ to operate the firing circuits 15′, 16′ and 17′.

The discharge circuits including controlled rectifiers 31, 32 and 33 are similar to the discharge circuits including controlled rectifiers 31′, 32′ and 33′; consequently, the circuit for controlled rectifier 31 and associated transformer 27 and the controlled rectifier 31′ and associated transformer 27′ is alone described.

The transformer 27 includes a primary winding 34 connected between the capacitor 23 and controlled rectifier 31. The primary winding 34 is coupled to the secondary winding 28 by a suitable transformer core 35 to provide an appropriate pulse to the gate of the rectifier 25 when the rectifier 31 is triggered on. The rectifier 31 is, in turn, controlled by the output of the trigger signal generator 14 which is schematically shown in FIG. 1 and diagrammatically illustrated in FIG. 2.

The present invention is directed to the trigger generator 14 and particularly to the connecting circuitry 18 and 18′ for sequential actuation of circuits 15, 15′, 16, 16′, 17 and 17′. Reference may be made to the previously referred to co-pending application as well as to U.S. Pat. No. 3,715,650 issued to James R. Draxler or to other known systems for details of construction not more fully set forth herein.

The generator 14 generally includes three separate windings 36, 37 and 38 which may be mounted on an angularly adjustable stator 39 as diagrammatically shown in FIG. 2. The stator 39 is positioned about a rotor 40 coupled directly to the engine drive shaft 41, and may be rotated manually to effect speed control. The windings 36, 37 and 38 are spaced ⅓ revolution (120°) apart.

The illustrated rotor 40 includes a paid of magnetic poles shown as a North pole 42 and a South pole 43 which defines a first polarity flux reversal at an abutting junction 44, and a second and opposite polarity flux reversal at an abutting junction 45 diametrically opposite junction 44.

In accordance with the present invention, the three windings 36, 37 and 38, respectively, together with rotating magnetic junction 44 generate three first polarity timing pulses for triggering controlled rectifiers 31, 32 and 33, respectively; and windings 38, 36 and 37, respectively, together with rotating magnetic junction 45 generate the three second and opposite polarity timing pulses for triggering the corresponding three controlled rectifiers 31′, 32′ and 33′, respectively.

The coils 36, 37 and 38 are illustrated with one end connected to the triggering circuits for plugs 1, 3 and 5, respectively, and as hereinafter described, provide firing at O, 120 and 240 crankshaft degrees. The opposite ends of the coils 38, 36, and 37, respectively, are similarly connected to the triggering circuits for plugs 2, 4 and 6, providing firing at 60, 180 and 300 crankshaft degrees.

Figure 3:
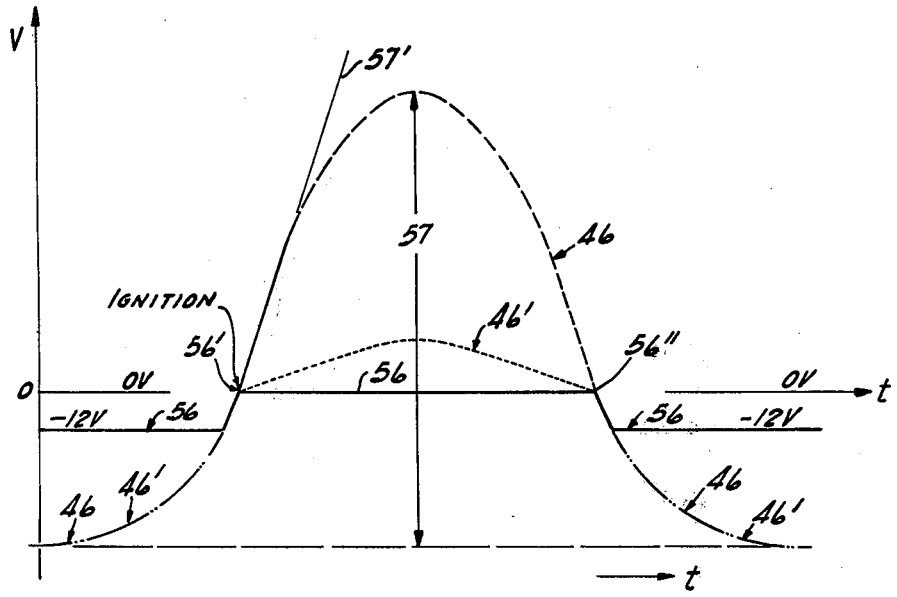
FIG. 3 is a graphical illustration showing a triggering pulse signal resulting from the circuit and structure shown in FIGS. 1 and 2.

Specifically, an extrapolated or lightly loaded timing pulse 46, such as shown in FIG. 3, for triggering controlled rectifier 31 is generated when magnetic junction 44 rotates past coil 36 in the proper direction of rotation, at which time the identified zero angle end of coil 36 is positive relative to the opposite end. One end of the coil 36 is connected to the controlled rectifier 31 for firing spark plug 1. A second and opposite polarity timing pulse for firing a different spark plug (4) is generated 180° later when the opposite magnetic junction 45 rotates past the same coil 36, in the same direction of rotation; at which time the other end of coil 36 is positive. The other end of the coil 36 is connected to controlled rectifier 32′ for firing spark plug 4 in accordance with the assumed firing order of 1, 2, 3, 4, 5 and 6. The other coils 37 and 38 similarly generate both positive and negative pulses. The opposite ends of coils 36–38 are appropriately connected by leads 47 and 48 so as to fire the spark plugs 1–6 in the desired order. Thus, coil 36 is connected to fire plugs 1 and 4, coil 37 is connected to fire plugs 3 and 6, and coil 38 is connected to fire plugs 5 and 2.

More particularly, the opposite ends of the three coils are connected through six different branch circuits, which are shown identical, one to the other, and that for coil 36 is described.

The branch circuit for coil 36 which supplies trigger signals to controlled rectifier 31 for the spark plug 1 of group 8 includes, in series, the winding 36, a diode 49, a gate input resistor 50, the gate-to-cathode junction of controlled rectifier 31, a common ground line 51, a bias capacitor 52 for stabilizing the firing of the controlled rectifier 31, a coupling line 53 to a line 54 of cascaded trigger circuit 18' for group 9, and a diode 55 to a return line 48 to the 180° end of winding 36. The gate-to-cathode junction of rectifier 31 acts much like a diode and current can flow into the gate and out of the cathode with a voltage drop very much like that of a forward-biased diode; current flow in the reverse direction encounters a very high impedance very much like that of a reverse-biased diode.

Actually, there are two bias capacitors 52 and 52' which are effectively connected in parallel by coupling line 53 (FIG. 1) and by the common engine block ground path shown at 51 and 51'. Applicant has found that the six-cylinder engine will have satisfactory ignition if the coupling line 53 is omitted, in which case the branch circuit for coil 36 which supplies trigger signals to controlled rectifier 31 includes, in series, the winding 36, diode 49, resistor 50, gate-to-cathode junction of controlled rectifier 31, ground line 51 to engine block ground, engine block ground to ground line 51', bias capacitor 52', line 54, and diode 55 to a return line 48 to the 180° end of winding 36. However, with coupling line 53 omitted, an open-circuit condition of one of the bias capacitors 52 or 52' or its connecting conductor pathways can have a damaging effect, particularly on the three cylinders fired by those branch circuits dependent upon the open-circuited bias capacitor or pathway. Applicant has found that at high engine speeds in the range of 5000 rpm, with the aforementioned type of failure, the ignition timing of the three cylinders dependent upon the opencircuited bias capacitor would be advanced 5.5°, while the other three cylinders would be advanced about 2°. Engine damage could easily occur due to excessive cylinder pressures and temperatures caused by the early ignition timing. Applicant has further found that the reinstallation of coupling line 53 restores all ignition occurrences to the correct timing, even in the presence of one disconnected or open-circuited bias capacitor. In addition, the presence of line 53 forces both ignition units 10 and 11 to operate with identical bias voltages, thereby cancelling any slight timing differences that might have been caused by bias voltage differences due to differences in the net resistances shunting the two bias capacitors.

The following descriptions will thus be based upon the inclusion of coupling line 53 which puts bias capacitors 52 and 52' in parallel.

When the timing pulse 46 generated by the winding 36 becomes large enough to overcome the bias voltage on capacitor 52, as well as supply the forward diode drop of the diodes 49 and 55 and the diode-like drop of the gate-to-cathode junction of controlled rectifier 31, then gate trigger current can begin to flow in the branch circuit. Assuming capacitor 23 has been charged, controlled rectifier 31 will trigger a discharge as soon as the very low gate triggering threshold current of rectifier 31 has been attained. This occurs at point 56' on the FIG. 3 plot of the trigger coil output. The subsequent gate current pulse from winding 36 that passes through the gate-to-cathode junction during the time from point 56' to point 56'' on the plot, acts to charge up the bias capacitor 52 and develop a self-bias voltage; a portion of which, in accordance with the invention, is impressed upon the gating circuits of the controlled rectifiers. The effect of the gate current pule that flows through the gate-to-cathode junction from point 56' to point 56'' causes the trigger pulse 46 to be loaded down such that the pulse takes on the shape 46'. Solid trace 56, representing the gate voltage on controlled rectifier 31, is slightly bulged upward by the gate current, reaching about +1.0 volt peak, whereas points 56' and 56'' are about +0.6 volt. Capacitors 52 and 52' are thus charged by the successive conduction through the gate circuits of controlled rectifiers 31, 31', 32, 32', 33 and 33' in accordance with the foregoing description and with the teaching of applicant's U.S. Pat. No. 3,805,759.

Turning particularly to FIG. 3, extrapolated triggering pulse 46 of the trigger signal generator 14 is diagrammatically illustrated with time and therefore with crankshaft angle. Where the ignition system is applied to an internal combustion engine for an outboard motor, the trigger generator 14 is generally designed to generate a peak voltage 57 of pulse 46, illustrated by the dashed trace, of approximately 135 volts at 6,000 revolutions per minute (rpm), under light resistive loading conditions. The triggering point 56' is desirably established on the leading edge of the pulse, which, for a permanent magnet generator, may have a generally sine wave configuration. The level at point 56' is desirably and preferably set between one-third and two-thirds of the peak voltage 57. As shown by the tangent line 57', this places the triggering level along the steepest portion of the pulse's leading edge which is also a relatively linear portion of the pulse. Typically, the triggering level will be set at approximately one-third of the peak voltage 57. This requires that the capacitor 52 provide a back-biasing voltage of approximately one-third of the peak voltage, or in the assumed ignition system with a peak voltage of approximately 135 volts, the capacitor 52 is to be charged to slightly less than 45 volts. The various diodes in the branch circuits plus the controlled rectifier gate triggering thresholds will raise the actual trigger level to approximately the 45 volt level. Prior to the invention, the full back-bias voltage of capacitor 52 would have been impressed in the reverse direction across the gate-to-cathode junction of each controlled rectifier, such as rectifier 31. However, the conventional controlled rectifier 31 employed in ignition systems and the like has a gate-to-cathode junction which breaks down in the presence of reverse voltage of approximately 12 to 15 volts, with a resulting reverse current flow into the cathode and out of the gate and through the interconnecting circuitry therebetween. This would of course drain the self-biasing charge on the capacitor 52, and in practice applicant has found that a maximum of about 17 volts on capacitor 52 is all that could be maintained using the bias circuit configuration prior to the present invention. In accordance with the invention, a voltage dividing network 58 is interposed between the self-biasing capacitor 52 and each of the gate circuits. Each voltage dividing network includes a pair of series connected resistors such as 59 and 60 connected directly across or in parallel with the capacitor 52. The one end of resistor 59 is connected to the common ground 51, while the second resistor 60 is connected via line 54′ to the capacitor 52 and coupling line 53. The common junction or node 61 between resistor 59 and 60 is connected to the input side of the gate resistor 50. The resistor 59 is therefore in parallel with resistor 50 in series with the gate-to-cathode junction of controlled rectifier 31.

With the output of winding 36 at zero or of an opposite polarity from that described to fire rectifier 31, the full voltage of the capacitor 52 is impressed upon the network 58 which divides such voltage to reduce the voltage across resistor 59 to less than the reverse voltage breakdown level of the gate-to-cathode junction of controlled rectifier 31. For example, a typical value may be 10 to 12 volts. The same voltage appears across the gate circuit and particularly the gate-to-cathode junction in series with gate resistor 50. Because the voltage is below the level at which the gate-to-cathode junction goes into reverse breakdown, essentially no current flow thru resistor 50, and thus there is no voltage drop across resistor 50. Thus the entire 10 to 12 volts appears across the gate-to-cathode junction as a reverse bias gate voltage.

A capacitor 62 is shown paralleling the gate-to-cathode junction of controlled rectifier 31 for the purpose of suppression of unwanted transient signals. Its effect upon the pulse triggering currents is so slight as to be negligible.

The voltage dividing network 58 does not therefore appreciably affect the circuit during the generation of the pulse signal 46 but does appreciably reduce the reverse voltage applied across the gate-to-cathode junction of the controlled rectifier 31 so as to essentially eliminate the drain of the gate-to-cathode junction on the capacitor 52.

The three separate dividers 58 associated with the three controlled rectifiers 31, 32 and 33, are equivalent to a single resistive bleeder across bias capacitor 52. By appropriate choice of resistor values, both the desired voltage dividing ratio and a suitable bleeder resistance is obtained. Typically, the dividing ratio is selected to limit the reverse gate voltage to about 10 to 12 volts at maximum engine speed, and the equivalent bleeder resistance value is chosen to establish a bias voltage such that the triggering threshold level is in the steep portion of the leading edge of the trigger pulse 46. The lowest value of bias voltage that produces this result generally allows for the use of the least costly bias capacitor; therefore the triggering threshold is normally set near the lower end of the steep section of the trigger pulse.

The result is a convenient method of maintaining an effective self-bias which results in a trigger signal appearing on the gate-to-cathode junction of controlled rectifier 31 typically illustrated in FIG. 3 by trace 56. The trace 56 of the gate voltage is typically as illustrated with respect to ground and the unloaded trigger pulse 46 is shown by the dashed line 46, and the loaded trigger pulse by dotted line 46′.

The unloaded trigger pulse 46 at 6,000 rpm is shown superimposed on the gate voltage 56. Assuming the self-bias capacitor 52 has been charged and is holding at approximately a negative 45 volts, the net effective threshold voltage is slightly greater, typically by about 1.8 volts (the required 0.6 volt forward triggering voltage of the gate-to-cathode junction of controlled rectifier 31, plus the 0.6 volt forward voltage drop of each of the two series diodes 49 and 55 in the triggering path of the gating circuit). Thus just prior to generation of the trigger pulse 46, the capacitor 52 and voltage divider 58 establish a negative 12 volts across the gate-to-cathode junction. The trigger pulse 46 rises from an equivalent bias level of −46.2 volts until it reaches the −12 volt level at which the gate is held. As the trigger pulse 46 continues to increase, the voltage on the gate now increases along the solid line trace in FIG. 3. When the voltage on the gate of the controlled rectifier 31 rises to approximately 0.6 volts positive, which is the usual triggering voltage, the gate-to-cathode junction conducts. The conducting gate circuit limits the gate voltage at approximately 0.6 to 1.0 volts until the trigger pulse 46 has peaked and decreased to the 0.6 volt level, after which it will retrace or decrease to the −12 volt level as shown by the full line trace 56.

Thus, the load on the coil 36 is primarily the resistance of the series-connected voltage dividing resistors 59 and 60 immediately prior to triggering. As the trigger input pulse 46 continues to increase in the positive direction from the −12 volt level the pre-trigger load is driven to and above ground until the gate triggering threshold level of +0.6 volts is established. The gate current is relatively low, in the order of 10 to 50 microamps, as the instant of triggering. After the gate triggering threshold has been reached, the gate current will rapidly increase with the further increase in the trigger pulse 46, up to a level of typically 15 milliamperes as a result of the significant decrease in the resistance of the gate-to-cathode junction with the gate input resistor 50 being added as part of the load. The current pulse supplied by the triggering coil 36 which flows through the resistor 50 and the gate-to-cathode junction serves to charge the bias capacitor 52. This pulse helps to keep the capacitor 52 charged to the desired bias voltage level. The circuit for each of the other rectifiers 32, 33, 31′, 32′ and 33′ are similarly connected in circuit to fire the respective spark plugs 2–6. Thus, as previously described, 180° after firing of plug 1, the junction 45 approaches winding 36 and develops an opposite polarity pulse which is coupled through a similar branch circuit for the spark plug group 9 to actuate the rectifier 32′ for firing of spark plug 4 via the coupling transformer 29′ to the main rectifier 25″ of branch 16′.

In operation, however, after coil 36 generates the pulse 46 to fire cylinder 1, the rotor 40 continues to rotate with the junction 44 moving through the dead space between coils 36 and 37 and with the opposite magnetic junction 45 approaching coil 38. The junction 45 moves past the coil 38 sixty degrees after the forming of the above pulse 46 and induces a voltage pulse with the positive voltage appearing at the 60° end of winding 38 as illustrated. The coil 38 is connected with the 60° end providing power to the triggering circuit for spark plug number 2. In particular, the 60° end of coil 38 is connected via a line 48 in the branch circuit for rectifier 31′. This branch circuit is similar to that previously described for the rectifier 31 and in particular includes the interconnecting line 48, a diode 49′, a gate resistor 50′, the gate-to-cathode junction of rectifier 31′, a common ground line 51′, a self-biasing capacitor 52′ for group 9 and the common return line 53 to return line 54′ and diode 55′ in the triggering circuit for spark plug group 8, and interconnecting line 47 back to the 240° or opposite end of the winding 38. Thus, 60° after firing of spark plug 1, winding 38 induces a similar pulse to fire the rectifier 31′. This results in the cascaded discharging of capacitor 23′ to fire the rectifier of branch 15' and thereby discharging of the capacitor 12' to fire spark plug 2.

The circuit operates in exactly the same manner as that previously described for the spark plug 1 with the selfbiasing capacitor 52' providing a stabilized operation of the rectifier 31'. The capacitor bias voltage when the pulse is absent is applied to the gate through a voltage dividing network 58' as previously decribed to limit the gate-to-cathode junction voltage below the reverse voltage breakdown level.

The system is particularly adapted to multiple cylinder engines for outboard motors and the like which employ both three cylinder and six cylinder constructions. Thus a pair of basic three cylinder ignition units are readily constructed with separate housings or enclosures 63 and 64, shown interconnected as applied to a six cylinder engine in FIG. 1. The six cylinder engine is designed to employ a pair of such basic three cylinder ignition units with the single generator 14 interconnected in a double ended configuration of its windings 36, 37 and 38. Thus, as previously described, the windings are connected to produce the desired alternate firing of the spark plug groups 8 and 9.

The three cylinder engine is designed to use only one basic ignition unit, together with a modified trigger generator in which the three trigger coils 36, 37 and 38 would be wye-connected, and where the neutral is brought out as a trigger common wire and connected to the bias capacitor. Specifically, to make a three cylinder system, FIG. 1 would be modified as follows:

Spark plug group 8 and ignition unit 10 and the interposed voltage step-up ignition transformers would remain, as would alternator portion 13 and trigger generator 14 and interconnecting wires 47 to the O, 120° and 240° ends of trigger coils 36, 37, 38. All other apparatus would be absent. The 180°, 300° and 60° ends of trigger coils 36, 37 and 38 would be joined together inside generator 14, and a neutral or common wire brought out of generator 14 which would connect to bias capacitor 52, taking the place of coupling lead 53.

Figure 4:
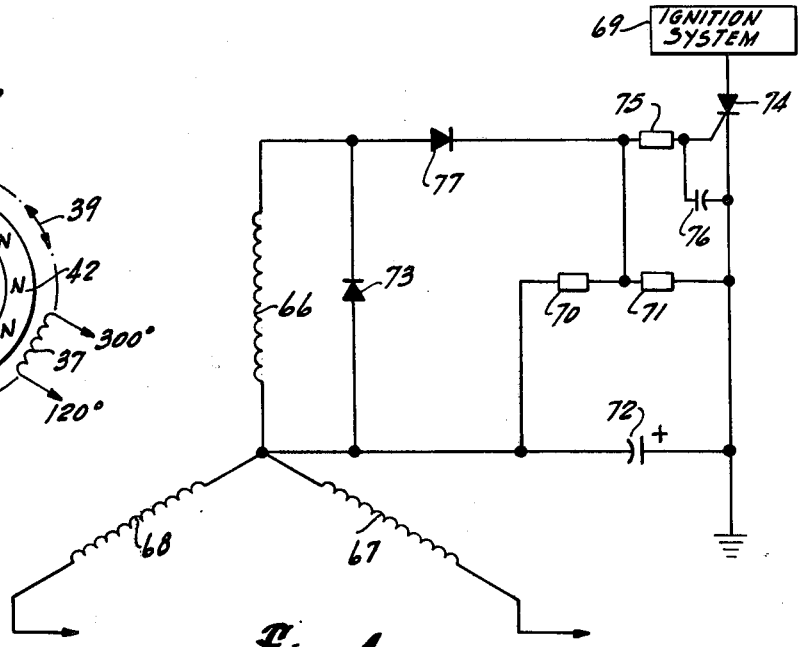
FIG. 4 is a partial schematic illustration of a triggering circuit similar to that shown in FIG. 1 for a single cylinder of a three-cylinder engine.

One triggering branch circuit for such a three cylinder engine application is shown in FIG. 4. Trigger generator windings 66, 67 and 68 correspond respectively to the above-mentioned wyeconnected modification of coils 36, 37 and 38 of FIG. 1. The trigger neutral or common wire is connected to the bias capacitor, here identified as 72. Divider resistors 70, 71 correspond to resistors 60 and 59, respectively, of FIG. 1. Diodes 77, 73 correspond to diodes 49, 65 respectively. Controlled rectifier 74 corresponds to controlled rectifier 31, gate resistor 75 to gate resistor 50, and suppression capacitor 76 to capacitor 62. Ignition system 69 corresponds to all of the elements of FIG. 1 connected to or following after the anode of controlled rectifier 31.

Bias capacitor 72 is charged by the sum total of the gate current pulses from windings 66, 67 and 68. Bias capacitor 72 is drained down to the approximately ⅓ peak trigger voltage level by resistors 70 and 71 in series, and also by two more sets of such series-connected resistors associated with the two windings 67 and 68.

Diode 73 is no. essential in the three-cylinder application, but it does eliminate the large reverse voltage pulse that would otherwise be applied to diode 77, and thus allows the use of a relatively inexpensive diode for diode 77 as well as for diode 73. Diode 73 is desired for the six-cylinder application as shown in FIG. 1, where its function was described using diode 55 as the example.

Thus the present invention provides a reliable and relatively simple method of implementing a relatively high voltage trigger signal source means combined with a relatively high voltage opposing self-biasing signal means, while simultaneously implementing a relatively moderate voltage reverse gate bias means applied to a gate-to-cathode junction of a controlled rectifier having a relatively moderate reverse breakdown gate voltage.

Various modes of carrying out the invention are contemplated as being within the scope of the following claims, particularly pointing out and distinctly claiming the subject matter which is regarded as the invention.

I clam:

1. In an ignition system for an internal combustion engine employing a triggered switch means for periodically transferring energy to a spark plug, said triggered switch means including an input means having a threshold forward switching level and a reverse blocking level, an improvement in an engine driven triggering signal source and its interconnecting circuit developing time spaced actuation of said switch means adapted to be connected to an engine and comprising, source means having an input means adapted to be driven in synchronism with said engine and connected to the switch means, said source means establishing an output signal operable to actuate said switch means, bias signal means connected in circuit with the source means and said switch means and establishing a modifiying bias signal applied substantially proportional to the output of the source means and utilizing a significant portion of the bias signal to modify the output signal from said source means during triggering periods to establish an effective variable threshold forward switching level essentially matched to the output voltage of the source and thereby maintain a constant triggering train for varying speed of said source means, said bias signal level rising significantly above said reverse blocking level of said switch means, signal limiting means connected across said bias means and across the input means and including voltage divider means having intermediate tap connected to said input means for impressing only a portion of the bias signal as a reverse voltage on said input means of said triggered switch means in the interval between triggering periods, said reverse voltage being limited to a value essentially below the reverse blocking level of the switch means.

2. The ignition system of claim 1 wherein said source means produces a voltage pulse having a leading edge with a well-defined essentially steep linear portion in the intermediate portion of the leading edge, said bias signal means establishing an effective threshold voltage within said step linear portion.

3. The ignition system of claim 2 wherein said bias signal means establishes said effective threshold voltage at approximately one-third of the peak voltage.

4. The ignition system of claim 2 wherein said pulse includes said steep linear portion between one-third and two-thirds of the peak voltage, and said bias signal means establishes said effective threshold voltage within said steep linear portion at approximately one-half of the peak voltage.

5. The ignition system of claim 1 wherein said limiting means includes a resistive dividing means connected across said bias signal means and having an intermediate node connected to the triggered switch means.

6. The ignition system of claim 5 wherein said limiting means includes first and second resistors connected in series across said bias signal means and having the common node connected to the switch means.

7. The ignition system of claim 1 wherein said source means includes a permanent magnet generator including a rotor adapted to be connected to said engine and producing angularly related spaced output triggering signals, each triggering signal varying in amplitude with the operating speed of the engine, and each signal being related in angle to the angle of the crankshaft of the engine.

8. The ignition system of claim 1 wherein said source means produces spaced output triggering signals each varying in amplitude with the speed of the engine.

9. The ignition system of claim 8 wherein said source means is a permanent magnet trigger pulse generator.

10. In the ignition system of claim 1 for a multiple cylinder engine having a plurality of said switch means, circuit means connecting the source means to said switch means and sequentially actuating said switch means in time spaced relation, said bias signal means being connected to each of said switch means and establishing a common modifying signal to each of said switch means, and said signal limiting means including a plurality of similar circuit means connected to each of said switch means and reducing the bias signal impressed on each said switch means in the interval between triggering periods.

11. The ignition system of claim 10 including an odd number of said switch means, a housing for said switch means and associated circuit elements to form a complete assembly for firing of a related number of cylinders, said triggering signal source means including a trigger generator having a stator with a corresponding number of trigger windings mounted in equicircumferentially spaced relation and a coaxial rotating rotor member connected to said engine and driven in synchronism with the engine for sequential coupling to the windings and generating angularly-spaced voltage pulses, said circuit means including individual circuit steering means connecting each of said windings to one of the said switch means.

12. The ignition system of claim 10 including a pair of substantially identical housings each containing a complete assembly for firing a like odd number of different cylinders, said triggering signal source means including a trigger generator having a stator with the same odd number of trigger windings mounted in equicircumferentially spaced relation and a coaxial rotating magnetic rotor member adapted to be connected to said engine and driven in synchronism with the engine for sequential coupling to said windings and generating angularly-spaced voltage pulses, each of said trigger windings developing alternate pulses of opposite polarities, said trigger windings having a first end of each winding connected to a selected individual input of the first assembly and the second end of each winding connected to a selected individual input of the second assembly, whereby said first and second assembly normally provide said bias signal for respectively establishing the effective threshold voltage of the second and first assemblies, said first and second assemblies normally establish a back-biasing voltage for its own individual switch means at a level significantly below the voltage level of the bias signal during the interval between trigger pulses on each such individual switch means, and a selectively connected jumper wire between said bias signal means of the two assemblies may be paralleled and made common, thereby allowing the resulting common bias signal means to establish both the effective threshold voltage and the backbias voltage for both assemblies.

13. The ignition system of claim 12 wherein said circuit means includes a first polarity branch circuit means having unidirectional conducting means connected to conduct the first polarity signals from each of said winding means to a corresponding switch means of said first assembly and to the bias signal means of the second assembly and a second opposite polarity branch circuit means having unidirectional conducting means connected to conduct the second polarity signals from each of said winding means to a corresponding switch means of said second assembly and to the bias signal means of the first assembly, an optional circuit path connecting the bias signal means of the two assemblies whereby the bias signals are made essentially identical, said signal limiting means including voltage dividing networks connected in parallel with each other and with said bias signal means, and each of said voltage dividing networks having a tap connected to the input means of a corresponding switch means.

14. An ignition system for an internal combustion engine having a controlled rectifier means controlling the periodic transfer of energy to a spark plug, said controlled rectifier means having a gate to cathode input junction defining a diode means with a selected and essentially fixed forward threshold triggering voltage and a moderate reverse voltage blocking level, comprising the improvement in a triggering signal source means for developing time spaced trigger pulse signals of a peak amplitude significantly greater than said forward threshold of said junction, bias signal capacitive means connected with the source means across the input junction and establishing a modifying bias signal substantially proportional to the output of the source means and thereby effectively establishing for forward trigger pulse signals a variable threshold triggering voltage essentially matched to the output voltage of the source, and a parallel voltage dividing means having a resistor means connected in parallel across said capacitive means and having an intermediate connecting tap to the gate of said input junction, said connecting tap being located intermediate the resistor means for reducing the back bias voltage impressed on said input junction during the interval between forward trigger pulse signals essentially to a level less than the reverse blocking level.

15. The ignition system of claim 14 wherein said voltage dividing means includes first and second resistors connected in series across said capacitive means and said connecting tap defined by a connection between said resistors.

16. The ignition system of claim 15 wherein said source means includes a permanent magnet generator having a rotor and angularly related spaced output triggering signals each varying in amplitude with the speed of the engine, and related in angle to the angle of the engine crankshaft.

17. The ignition system of claim 14 wherein part of each of said pulse signals resemble a sine-wave and includes an essentially linear portion of greatest slope between one-third and two-thirds of the peak voltage, and said signal means establishes said threshold voltage at approximately one-half off the peak voltage.

18. An ignition system triggering apparatus for a multiple cylinder internal combustion engine having alternate fired ignition means and a plurality of triggered switch means each having individual input means having a forward threshold triggering level and a reverse blocking level, said switch means being divided into a first group to fire the even alternate cylinders in each firing sequence and a second group to fire the odd alternate cylinders in each firing sequence, comprising a trigger pulse generator having a plurality of trigger windings mounted in equicircumferentially spaced relation and a coaxial rotating magnetic rotor unit with equicircumferentially spaced discontinuity of opposite flux changes, the rotor unit adapted to be connected to said engine and thereby driven in synchronism with the engine for sequential coupling to the windings and generating a first family of triggering pulses of first polarity and generating a second family of triggering pulses of an opposite polarity interspaced with the first family, a pair of bias capacitors one for each of a first individual circuit means connecting the first end of each of said triggering windings to the individual input means of one group of switch means and a second individual circuit means connecting the second end of each of said windings to the input means of the second group of switch means wherein said same triggering winding is operative to fire a cylinder of each group, each of said circuit means including a first polarity branch circuit means having diode means connected to conduct signals from each one end of each of said winding means to a corresponding switch means of said first group and from each second end of each of said winding means to a corresponding switch means of said second group, and having an optional common return path connected between the bias capacitor of one group to the bias capacitor of the other group, said bias capacitor of each group being connected in series with a diode in the opposite group, and voltage limiting means connected across said capacitors and across the input means of the switch means and including means to impress only a portion of said bias capacitor voltage across said input means as a reverse voltage to the said individual input means.

19. The ignition system of claim 18 wherein said generator produces a voltage pulse with an essentially linear portion of maximum dv/dt in the intermediate portion of the leading edge, said bias signal means establishing a net or effective forward threshold triggering voltage within the portion of maximum dv/dt.

20. The ignition system triggering apparatus of claim 19 wherein said voltage limiting means includes a plurality of voltage dividing networks connected in parallel with each other and with each of said capacitors, each of said voltage dividing networks having an intermediate node connected to the input of a corresponding switch means.

21. The ignition system triggering apparatus of claim 20 wherein each voltage dividing network including a pair of series connected resistors with said intermediate node at the connection of said resistors.

22. The ignition system of claim 18 having a separate housing for each of said groups of switch means and and corresponding circuit means, and a conductive means connecting the ground conductor of each of said groups of switch means to one another and to the engine block.

23. In an ignition system employing individual triggered switch means for an odd number of cylinders, each of said switch means having an input means, a trigger generator having an odd number of windings with a neutral lead connecting a first end of each winding to each other, a bias capacitor connected to said neutral lead of said trigger generator, a diode connecting the second end of each winding to said input means to apply only forward polarity voltage to the input means of the corresponding triggered switch means thus placing the essentially entire bias capacitor voltage effectively in series with the trigger pulses to establish modified forward trigger pulses, at least one voltage divider network connected in parallel with the bias capacitor and having a tap furnishing only a portion of the bias voltage, and connecting resistor means connected to said tap and to said input means and applying only said portion of the bias voltage as a reverse voltage across the input means of each said triggered switch means during those intervals when the corresponding diode is not conducting in the forward direction.

24. In an ignition system employing individual triggered switch means having input means for an even number of cylinders, a generator having a plurality of windings, one group of source circuits having a bias capacitor means connected through return diodes to a first end of each winding to the input means to apply only second-end forward polarity voltage to the input of the corresponding switch means, second return diodes connecting said bias capacitor means to the second end of each winding, second coupling diodes connecting first end of each winding to the input means to apply only first-end forward polarity voltage to the input of the corresponding switch means, thus placing the entire voltage of the bias capacitor means effectively in series with the second-end and alternatively the first end forward polarity trigger pulses to establish modified forward trigger pulses, at least one voltage divider network connected in parallel with said bias capacitor means and having a tap furnishing only a portion of the bias voltage from each capacitor means, and connecting resistor means connected to said tap and to said input means and applying only said portion of the bias voltage from each capacitor means to the input means of each associated triggered switch means during the interval when the corresponding coupling diode is not conducting.

* * * * *

UNITED STATES PATENT AND TRADEMARK OFFICE

CERTIFICATE OF CORRECTION

PATENT NO. : 4,015,564

DATED : April 5, 1977

INVENTOR(S) : ARTHUR O. FITZNER

It is certified that error appears in the above-identified patent and that said Letters Patent are hereby corrected as shown below:

| | | | |
|---|---|---|---|
| ABSTRACT, | | Line 4, | after "several" cancel "spar k" and insert --- spark ---; |
| Column | 2, | Line 20, | at the beginning of the line, cancel "387439" and insert --- 3,874,349 ---; |
| Column | 2, | Line 32, | before "first" cancel "of" and insert --- or ---; |
| Column | 2, | Line 61, | cancel "Extrapolatin" and insert --- Extrapolation ---; |
| Column | 10, | Line 25, | after "amps," cancel "as" and insert --- at ---; |
| Column CLAIM 2 | 12, | Line 56, | before "linear" cancel "step" and insert --- steep ---. |

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*